US010913513B2

(12) United States Patent
Lashmann

(10) Patent No.: US 10,913,513 B2
(45) Date of Patent: Feb. 9, 2021

(54) CATAMARAN TYPE VESSEL

(71) Applicant: SUNREEF VENTURE S.A., Gdańsk (PL)

(72) Inventor: Michal Lashmann, Gdańsk (PL)

(73) Assignee: SUNREEF VENTURE S.A., Gdansk (PL)

( * ) Notice: Subject to any disclaimer, the term of this patent is extended or adjusted under 35 U.S.C. 154(b) by 112 days.

(21) Appl. No.: 16/385,132

(22) Filed: Apr. 16, 2019

(65) Prior Publication Data

US 2020/0262518 A1 Aug. 20, 2020

(30) Foreign Application Priority Data

Feb. 15, 2019 (PL) ..... 428923

(51) Int. Cl.
*B63B 27/16* (2006.01)
*B63B 3/48* (2006.01)
*B63B 1/12* (2006.01)

(52) U.S. Cl.
CPC ..... *B63B 3/48* (2013.01); *B63B 1/121* (2013.01); *B63B 2003/485* (2013.01); *B63B 2027/165* (2013.01)

(58) Field of Classification Search
CPC ... B63B 2027/165; B63B 27/16; B63B 27/36; B63B 2023/485; B63B 2029/022; B63B 1/121
See application file for complete search history.

(56) References Cited

U.S. PATENT DOCUMENTS

| | | | | |
|---|---|---|---|---|
| 4,742,795 | A * | 5/1988 | DePrey | B63B 19/08 114/343 |
| 7,946,243 | B1 * | 5/2011 | Ulrich | B63B 27/16 114/362 |
| 9,586,655 | B1 * | 3/2017 | Butler | B60R 3/02 |
| 9,815,527 | B2 * | 11/2017 | Robertson | B63B 23/40 |
| 2013/0340668 | A1 | 12/2013 | Robertson | 114/343 |
| 2014/0026805 | A1 * | 1/2014 | Mueller | B63B 27/14 114/362 |
| 2017/0129574 | A1 * | 5/2017 | Brown | B63B 27/143 |

FOREIGN PATENT DOCUMENTS

| | | |
|---|---|---|
| FR | 2 931 448 A1 | 11/2009 |
| FR | 3 054 820 A1 | 2/2018 |

* cited by examiner

*Primary Examiner* — Andrew Polay
(74) *Attorney, Agent, or Firm* — Ostrolenk Faber LLP

(57) ABSTRACT

A catamaran type vessel that includes two rigid side hulls connected by a connector to form a rigid form containing a usable space. The vessel contains a lowered and lifted platform together with the platform drive unit. The platform is a separate portion of the aft part of the deck, in the form of a flat frame with a usable overlay fixed on the surface of the frame. An edge of the platform in the upper position cooperates with an edge of the aft part of the deck, with the platform frame being attached to the horizontal edges of two supports. The rear vertical edge of each support is connected by axes of rotation with a pair of rigid arms in the pantograph system connected with two horizontal axes of rotation attached on the other side of the rigid arms to the vessel hull connector wall.

10 Claims, 6 Drawing Sheets

CATAMARAN TYPE VESSEL

CROSS-REFERENCE TO RELATED APPLICATION

The present application claims priority to Polish Patent Application No. P.428923, filed Feb. 15, 2019, the content of which is incorporated herein by reference.

FIELD OF THE INVENTION

The invention relates to a catamaran type vessel. This term in this patent specification means a vessel with its own sail, motor or mixed propulsion, with two side hulls connected by a wet deck where the hulls together with the connector constitute a rigid form containing the usable space of the vessel. The solution according to the invention is dedicated especially to large catamaran yachts and swath boats and relates to the aft section of the vessel.

BACKGROUND OF THE INVENTION

Large yachts, including catamaran yachts, as well as other vessels, are often also equipped, in addition to pneumatic life-rafts, with boats for tourist and rescue purposes. The boats are usually attached in the aft section using mechanisms which ensure that they can be launched in a short period of time in the event of circumstances requiring the vessel to be abandoned. These boats are usually 2 to 8 metres long. The problem of this type of boats on large yachts is more complicated than on ships, where there is much more space for the location of the boats themselves, as well as the operating mechanisms for their launching and taking out of the water. On yachts, even large ones, there is less space available both for the boats themselves and for the operating mechanisms for these boats. The use of this type of boats with rigid or pneumatic hulls, with their own motor propulsion, is wider on large yachts, not limited to rescue tasks, but also includes recreational activities of the users. Expectations of the owners of such yachts are therefore focused on facilitating launching and taking these boats out of the water, which for this purpose are usually speed boats often on pontoon floats. In addition to rescue tasks, when needed, these boats also perform recreational functions, serving passengers for excursions or transport to a nearby land, where a larger yacht cannot approach.

For these reasons, the structures of large yachts are designed with the aim of facilitating maneuvers in launching and taking these boats out of the water, which contributes to the attractiveness of using yachts. There are known solutions for devices used to manoeuvre such boats. The solutions of lowered and lifted aft platforms with said boats are used on large catamaran yachts. A catamaran contains two rigidly connected hulls that are generally parallel to each other. Such yachts are designed in various sizes, from large ocean-going vessels to small yachts. They can be provided with both motor and sail propulsion.

One of the advantages of the hull of a catamaran type vessel is an above-water connector, which is a part of the deck form between the side hulls. In a number of known solutions, it allows the location of utility solutions. There are known solutions, where in the aft part of the vessel between the side hulls, an aft extreme mobile platform is designed, which is adapted to be lowered to the surface of the water and lower and lifted back to the surface of the aft part of the deck. In addition to the applications for launching and taking the boat described above out of the water, this platform can also perform a recreational function, allowing passengers to enjoy water sports.

This type of solution, dedicated to a catamaran type vessel, is known from French patent specification FR 2931448. This document presents a device for the vertical movement of a load-carrying platform while keeping it horizontal. The device, between the catamaran hulls, comprises a platform on which a load is placed, or a boat is attached, e.g. a pontoon boat. The device contains a nacelle to which a support arm, being the base to which the platform is fixed, is articulately attached. Said nacelle is from the other side attached to a mounting arm, the free end of which is tiltingly fixed to the boat hull structure, on a horizontal axis of rotation, running transversely to the plane of longitudinal symmetry of the yacht. Said at least one mounting arm has a variable inclination which allows lowering and raising the platform with the boat, for launching or taking the boat out of the water. Along the mounting arm, a metal rod is slidably fixed, articulately connected on one side with the nacelle and on the other side with the hydraulic cylinder piston rod. The hydraulic cylinder barrel eye on the other side is connected to the end of the mounting arm, which is tiltingly attached to the hull of the yacht. As mentioned above, the platform, according to this known solution, is attached on at least one nacelle with a tilting mounting arm. In some known solutions, there are two side nacelles, on two mounting arms and to these two nacelles a platform is attached on the support arms on the right and left side. The mounting arms work in parallel and lift the platform attached to the support arms. Each of the mounting arms is provided with the described sliding rod connected to the described cylinder. The sliding rod is an extension of the cylinder piston rod.

To the cylinder piston rod a rope pulley is attached, through which a flexible tensile force transmission means is provided, e.g. in the form of a flexible tie, fastened on one side to the fixed point of the hull. The tie is provided through said rope pulley of the cylinder piston rod of said mounting arm, and the other end of the tie is attached to said tilting mounting arm at a fixed point of the arm. In this known solution, the extension of the piston rod from the cylinder barrel increases the distance between the fixed point of attachment of the tie to the hull and the fixed point of attachment of the tie to the lifting arm. This is due to the displacement of the rope pulley together with the cylinder piston rod, which causes the lifting arm to be tilted, and through the nacelle and the support arm the platform to be lowered towards the water surface. The complete extension of the piston rod from the cylinder barrel causes the maximum lowering of the platform, which allows, for example, launching the boat located on the platform. The complete insertion of the piston rod into the cylinder barrel reduces a distance between the fixed point of attachment of the tie to the hull and the fixed point of attachment of the tie to the lifting arm, thus raising the platform to the upper level planned in the design together with the boat taken out of the water. The metal sliding rod is an extension of the cylinder piston rod and cooperates with the support arm, correcting in the pantograph system the level of the platform during lifting and lowering. This known solution also proposes a screw adjustment unit for the length of the lifting arms when the position of one of the support arms needs to be adjusted when the platform is located on the right and left on the two support arms in order for the platform to maintain its horizontal position.

Another solution, known from patent specification FR 3054820, presents another version of a unit for lowering and lifting a platform in the aft part of a catamaran type vessel where a cylinder attached to a lifting arm together with a rope pulley unit through which a flexible tie is provided was also used.

Another known solution is presented in patent document US 2013/0340668. The invention relates to an apparatus for raising and lowering boats, platforms, and cargo in the aft part of a catamaran type vessel. The apparatus comprises a platform and at least one lifting assembly. The assembly further comprises a shuttle between the extreme positions, a link arm connected to the shuttle, and a control link attached to the link arm. All elements are configured to move the link arm with the platform between first and second positions. In some aspects, the apparatus exhibits pantograph-like movement, making it easier to raise and lower boats, platforms and cargo horizontally. This specification describes a known lift apparatus mounted on a multi-hull vessel, such as a catamaran, configured for lifting a combination swim and dinghy platform. According to this known solution, the mobile platform is mounted on at least one support arm and is attached to the fixed hull structure on two pairs of essentially parallel tilting arms, on the right and left side of the mobile platform, allowing the platform to be raised and lifted, while maintaining its horizontal position.

In the case of catamaran or swath type vessels, in known solutions, a mobile aft platform is a lowered and lifted portion of the aft above-water part of the deck, which is located between the rear parts of the catamaran hulls and cooperates with at least one edge of the recess in the aft part of the deck.

SUMMARY OF THE INVENTION

Solutions known from the prior art include a number of drive transmission components for lowering and lifting a platform in the aft part of a catamaran type vessel. The location of a drive unit of this platform in the lower part of the vessel connector makes that a cylinder is arranged preferably in a position close to the horizontal position, or a cylinder with small piston rod stroke is used. This positioning of a cylinder requires the use of a mechanism containing more drive transmission components, including mechanisms containing flexible ties with a rope pulley system, which is not advantageous both for the efficiency of such mechanisms and for their possible failure. The purpose of the invention is to simplify the aft platform drive mechanism, and thus increase its efficiency.

This task is solved according to claim 1, by attaching a cylinder barrel of the drive mechanism of a unit for lowering and lifting the aft platform, inside a support pillar located in the aft part of a catamaran type vessel. Support pillars located in the aft part of said type of a vessel, supporting the sun deck on the right and left side above this part of the vessel, are hollow sections with a relatively spacious interior. The interior of the pillars allowed hydraulic cylinders to be placed there, whose piston rods extend directly to the rigid guide arms in the right and left pantograph system of the aft platform according to the invention. The inside of the right and left pillars also allowed the necessary tilting of the barrels of said cylinders fixed inside the pillars. The inside of the pillars also makes it possible to change the angle of inclination of the cylinder of each of the two, right and left, cylinders when lowering and lifting the aft platform. In the solution according to the invention, between the pantograph guide arm and a fixed structure of the vessel in the form of a support pillar, there is one drive transmission component in the form of a cylinder. This applies to the drive components on the right and left side of the aft platform. With the solution according to the invention, indirect drive transmission components have been eliminated, thereby increasing the efficiency and reliability of the platform drive unit. The cylinder barrel placed in such a way, with the piston rod downwards, is additionally mechanically protected inside the pillar section, and is also protected against the direct action of seawater. Most of the voyage time, the piston rod in the raised position of the platform, is hidden in the cylinder barrel, which is advantageous from the corrosive point of view.

The bending of the guide arm adjacent to the aft platform support, and the use of gusset plates allowed the cylinder piston rod to be mounted on a horizontal axis, outside the theoretical line connecting both ends of the bent guide arm, which is very important for the safety of fixing the piston rod to the pantograph, especially when sailing. At the same time, the gusset plates used here strengthened both guide arms of both pantographs, and made it possible to obtain a shape similar to the letter L, where the shorter section of this letter L is directed upwards and, cooperating with the fixed part of the connector structure of a catamaran type vessel, between the side hulls, constitutes a lock of the upper position of the aft platform.

The fixing arm in the pantograph system is a hollow section which contains a cut along its length, with both parts of the fixing arm thus cut being provided with cooperating flanges connecting said parts together in a detachable manner. If necessary, during the periodic inspection of a vessel at the dock, the flanges can be disconnected and spacers placed between them, leading to an adjustment of the level of the aft platform according to the invention in the event of a change during use.

The invention also solves the issue of parking on a catamaran type vessel a personal watercraft, intended for use by passengers or crew. The proposed solution allows launching a personal watercraft from the surface of the proposed support flap located adjacent to the aft platform according to the invention. Raising the support flap makes it possible to close a personal watercraft in the space between the deck and the hull connector wall. The proposed solution creates space for storing also other equipment, according to the needs of the users of the vessel, as well as allows the platform to be used when the personal watercraft attached on the support flap is operated.

According to the invention, a catamaran type vessel comprises two rigid side hulls connected by a wet deck. The hulls together with the connector constitute a rigid form on the basis of which the usable space of the vessel is built. The vessel is provided with propulsion and control devices and other known equipment for the safety and comfort of passengers and crew. The vessel contains a lowered and lifted platform together with the platform drive unit, with the platform being a separate portion of the aft part of the deck, in the form of a flat frame with a usable overlay fixed on the surface of the frame. At least one edge of the aft platform in the upper position cooperates with at least one edge of the aft part of the vessel, with the aft platform frame in this solution being attached to the horizontal edges of the right support and the left support of the platform. The rear vertical edge of each support is connected by axes of rotation to two pairs of rigid arms in the pantograph system, with the rigid arms being hollow sections. The other ends of both rigid arms of each pantograph are connected to two horizontal axes of rotation attached to the lower part of the connector of both vessel hulls. In each pair of the rigid arms in the pantograph system, one arm is a guide arm and the other arm is a fixing arm of the platform level. The guide arm in each pair of the arms is connected by means of the axis of rotation to a cylinder piston rod for lowering and lifting the aft platform, with a barrel of said cylinder being tiltingly attached to the fixed part of the vessel structure, in the connector zone between the side hulls.

According to the invention, the vessel is characterised in that the fixed part of the vessel connector structure, to which the cylinder barrel for lifting and lowering the platform is tiltingly fixed, is the internal surface of the hollow section, which is the support pillar of the aft part of the next level of the vessel. The next level of the vessel is understood in this patent specification as a higher sun deck or roofing over the deck.

In the platform drive unit, the end section of the pantograph guide arm adjacent to the aft platform support is preferably bent with respect to the other section of the guide arm so that the two sections of the guide arm form an obtuse angle. Within this connection of said two sections of the guide arm, gusset plates are attached to the guide arm.

The axis of rotation at the end of the cylinder piston rod for lowering and lifting the aft platform is preferably fixed between said gusset plates of each guide arm, between the arms of the obtuse angle, beyond the axes of longitudinal symmetry of both sections of the guide arm.

In a preferred embodiment of the solution according to the invention, the gusset plates of each guide arm have a shape similar to the letter L, the shorter element of which is directed upwards. This part of the gusset plate, cooperating with the lower part of the vessel hull connector, between the side hulls, constitutes a lock of the upper position of the aft platform.

The fixing arm in each pair of the arms in the pantograph system is preferably a hollow section, which contains a transverse cut along its length. Both parts of the fixing arm thus cut are provided with cooperating flanges connecting said parts together.

Between the flanges connecting the sections of the fixing arm there is preferably at least one distance washer. Further distance washers allow adjusting the horizontal position of the aft platform.

At the bottom of the connector between the vessel hulls, adjacent to the aft platform, on the bow side of the vessel, preferably a seat assembly with a closing tilting support flap is formed. The tilting support flap is connected with the edge of the seat in the connector wall by means of the axis of rotation, where said support flap is provided with devices for pulling onto its surface and lowering a load, and a load securing assembly on the upper surface of said tilting support flap. The support flap contains at least two locks blocking its position in the closed position.

A device for pulling and lowering a load is preferably a winch mounted on the support flap near the edge of connection of said tilting support flap with the vessel hull connector skin. The tilting support flap is provided on both sides with mounting eyes of the cylinder piston rods for closing and opening the flap.

A load on the upper surface of the tilting support flap, in a preferred embodiment of the invention, is a personal watercraft.

A personal watercraft securing assembly may be, attached to the upper surface of the support flap, rails and eyes for weathering a personal watercraft.

BRIEF DESCRIPTION OF THE DRAWINGS

The subject of the invention is shown in the embodiment in the attached drawing, in which the following figures illustrate.

DESCRIPTION OF PREFERRED EMBODIMENTS

Figure 1:
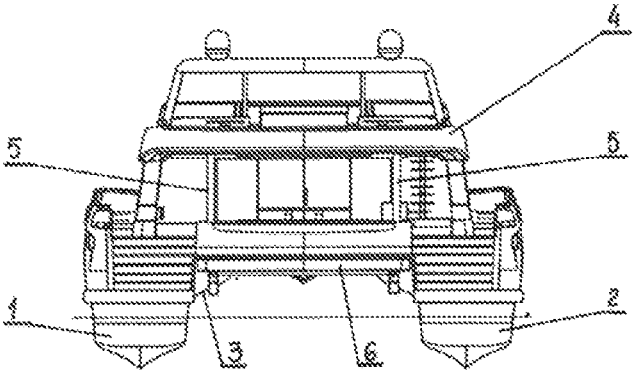
FIG. 1—a view of a catamaran type vessel from the stern side.

FIG. 1 shows in an embodiment a catamaran type vessel seen from the stern. The vessel comprises two rigid side hulls 1,2 connected by a connector 3. The side hulls 1,2 together with the connector 3 constitute a uniform, rigid form on the basis of which the usable space of individual parts of the vessel is built. In this embodiment, the wall thickness of this form is 40 mm and is a known composite layered structure. A uniform form in the form of two side hulls 1,2 connected by the connector 3 is created from such a layered material.

The vessel in this embodiment is provided with a sun deck 4 supported on two rear pillars 5. The side hulls 1,2 together with the connector 3, the sun deck 4 and other structural elements constitute a rigid form closing the usable space of the vessel. The vessel is provided with commonly used propulsion and control devices and other known equipment for the safety and comfort of passengers and crew.

Figure 3:
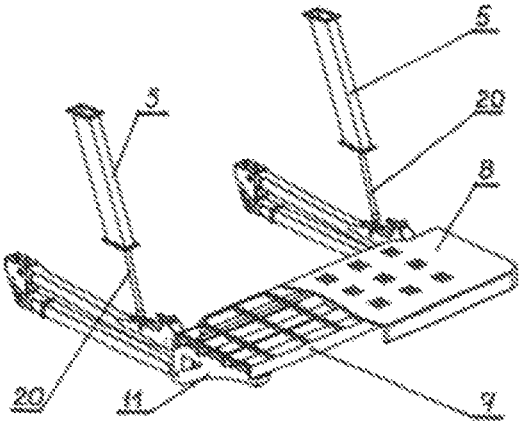
FIG. 3—a view of the aft platform mechanism in the upper position.
Figure 4:
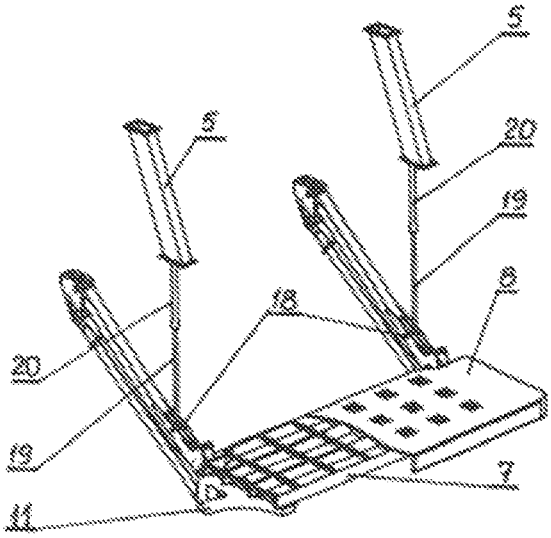
FIG. 4—a view of the aft platform mechanism in the lower position.

The vessel in this embodiment contains a lowered and lifted platform 6 together with the platform drive unit, with the platform 6 being a separate portion of the aft part of the deck, in the form of a flat frame 7 with a usable overlay 8 fixed on the surface of the frame. This is shown in FIG. 3 and FIG. 4. The frame 7 is made in this embodiment in the form of a metal truss, and the usable overlay 8 in this embodiment is a composite plate with a rough surface. In other embodiments, the frame and the overlay can be made of other materials.

Figure 2:
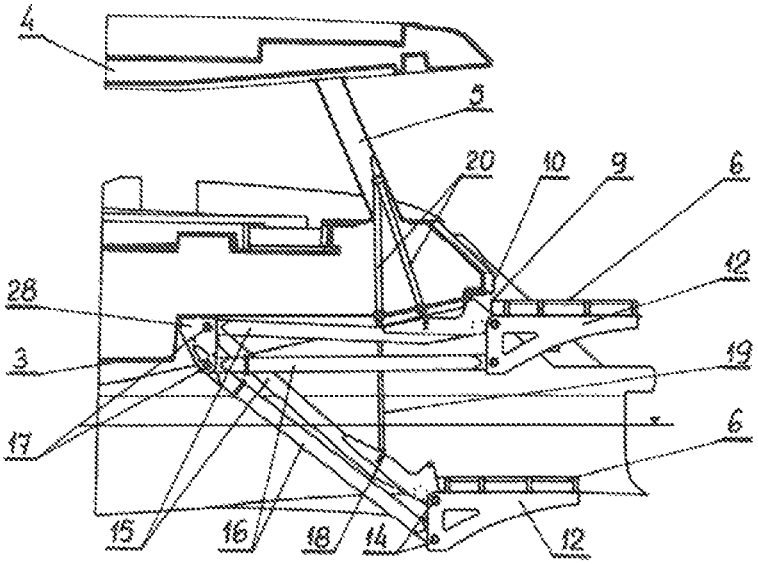
FIG. 2—a section of the aft part with the plane corresponding to the axis of longitudinal symmetry of a support pillar, with the aft platform visible in the upper and lower position.

FIG. 2 shows that the edge 9 of the platform 6 in the upper position cooperates with at least one edge 10 of the aft part of the vessel connector 3. This figure shows that the edges 9,10 are adjacent to each other and are adjusted in shape so that there is no gap of dangerous width between the edges 9,10.

Figure 7:
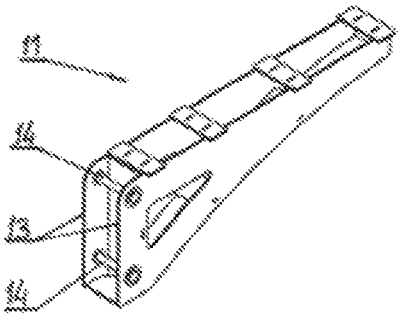
FIG. 7—a support.
Figure 8:
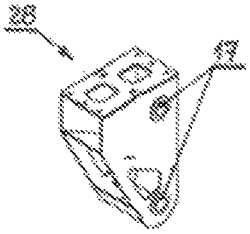
FIG. 8—clamps of rigid arms.

The aft platform 6 frame 7 in this embodiment is attached to the horizontal edges of a right support 11 and a left support 12. The support 11 is shown in a view in FIG. 3 and FIG. 4, as well as in detail in FIG. 7. The support 12 has the same structure. FIG. 2 shows a section of the platform mechanism in two positions: lower and upper. Therefore, in this figure, the support 12 is shown in two positions.

The rear vertical edge 13 of the support 11 is connected by axes of rotation 14 with two rigid arms 15,16 in the pantograph system, with the rigid arms 15 being hollow sections with a rectangular cross-section. The other ends of both rigid arms 15,16 of each pantograph are pivotally mounted on horizontal axes of rotation 17 mounted in fastening clamps 28 attached to the lower part of the connector 3 of both vessel hulls 1,2. This is shown in FIG. 2.

In each pair of the rigid arms 15,16 in the pantograph system, one arm is a guide arm 15 and the other arm is a fixing arm 16. The fixing arm is intended to maintain the horizontal position of the platform 6 during lifting and lowering. In this embodiment, as shown in FIG. 2, FIG. 3 and FIG. 4, the fixing arm 16 is below the guide arm 15, but in other embodiments the relative position of the arms 15,16 can be reversed.

FIG. 4 shows that the guide arm 15 in each pair of the arms 15,16 is connected by means of the axis of rotation 18 with a cylinder piston rod 19 for lowering and lifting the aft platform 6. A barrel 20 of said cylinder is tiltingly attached to the fixed part of the vessel structure, in the connector 3 zone between the side hulls 1,2.

In the solution according to the invention, the fixed part of the vessel connector 3 structure, to which the cylinder barrel 20 for lifting and lowering the platform 6 is tiltingly fixed, is the internal surface of the hollow section, which is the support pillar 5 of the aft part of the sun deck 4. In other embodiments, the pillar 5 may be a support for other elements constituting the next level of the vessel, e.g. a sun deck above the aft part of the deck. The position of the cylinder barrel 20 attachment is shown in FIG. 2, FIG. 3 and FIG. 4.

Figure 5:
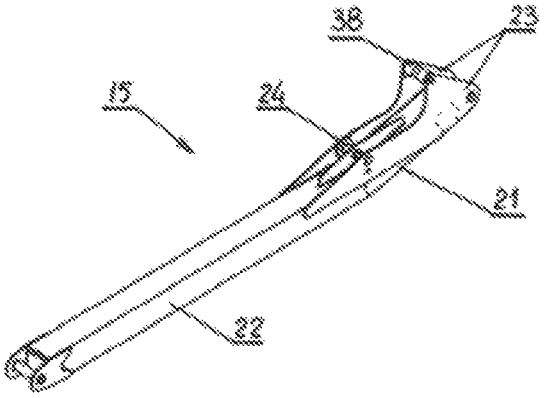
FIG. 5—a pantograph guide arm.
Figure 6:
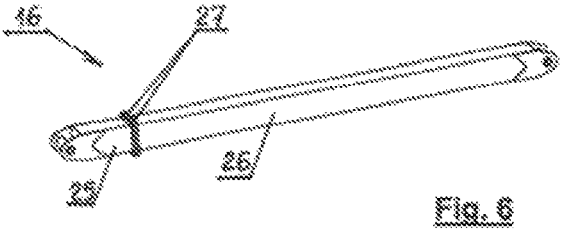
FIG. 6—a pantograph fixing arm.

In the platform drive unit 6, the end section 21 of the guide arm 15 adjacent to the aft platform 6 support 11,12 is preferably bent with respect to the other section 22 of the guide arm 15 so that the two sections 21,22 of the guide arm 15 form an obtuse angle. This is shown in FIG. 5. This figure shows that within this connection of said two sections 21,22 of the guide arm 15, gusset plates 23 are attached to the guide arm 15. The second guide arm 16 in the second pantograph, on the other side of the platform 6, is constructed in the same way. To the gusset plates 23 in each guide arm 15 an axis 24 is attached on which the cylinder piston rod 19 eye is tiltingly mounted. The axis of rotation 24 on which the cylinder piston rod 19 eye for lowering and lifting the aft platform 6 is mounted is fixed in this embodiment between the gusset plates 23 of each guide arm 15, between the arms of the obtuse angle, thus beyond the axes of longitudinal symmetry of both sections 21,22 of the guide arm 15.

In a preferred embodiment of the solution according to the invention, the gusset plates 23 of the guide arm 15 have a shape similar to the letter L. This is clearly shown in FIG. 2 and FIG. 5. The gusset plate 23 is positioned in such a way that the shorter element of the letter L is directed upwards. This part of the gusset plate 23, cooperating with the lower part of the connector 3 wall, between the vessel side hulls 1,2, constitutes a lock of the upper position of the aft platform 6. Between the gusset plates 23 of each of the guide arms 15 a roller 38 constituting said lock is fixed. At the same time, the roller 38 cooperates with a known hydraulic lock spindle, not shown in the drawings, which is placed under the roller 38 and locks the platform 6 in the upper position shown in FIG. 3.

The fixing arm 16 in each pair of the arms 15,16 in the pantograph system in this embodiment is a hollow section with a rectangular cross-section. The arm 16 contains a transverse cut along its length dividing the arm into parts 25,26. Both parts 25,26 of the fixing arm 16 thus cut are provided with cooperating known flanges 27 connecting said parts 25,26 together. Between the flanges 27 connecting the parts 25,26 of the fixing arm 16 in this embodiment there is a known distance washer, not shown in the drawing, for adjusting the horizontal position of the platform 6. According to this embodiment, further distance washers with the same or different widths can be inserted between the flanges 27 of both parts 25,26 of the fixing arm 16. The effect of inserting these known distance washers between said flanges 27 is the extension of the fixing arm 16, thus the horizontal adjustment of the platform 6, if necessary. The removal of the distance washers from between the flanges 27 connecting the parts 25,26 of the fixing arm 16 shortens the length of the fixing arm 16, thus adjusts the level of the platform 6 in the opposite direction.

The ends of the guide arm 15 and the fixing arm 16 are pivotally mounted on the axes of rotation 17 in the fastening clamps 28 attached to the bottom of the vessel connector 3. This is shown in FIG. 2.

The platform 6 is provided in this embodiment, on its working surface, with known, not shown in the attached drawings, securing seats for a pontoon motorboat. In other embodiments, other types of boats or other items can be secured on the platform, depending on the needs of the user of the vessel.

Figure 9:
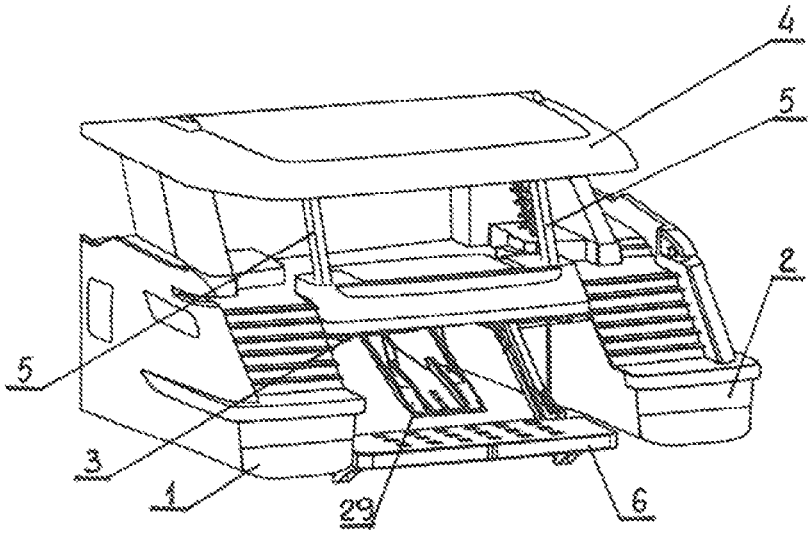
FIG. 9—a perspective view of the aft side of the vessel with a support flap.
Figure 10:
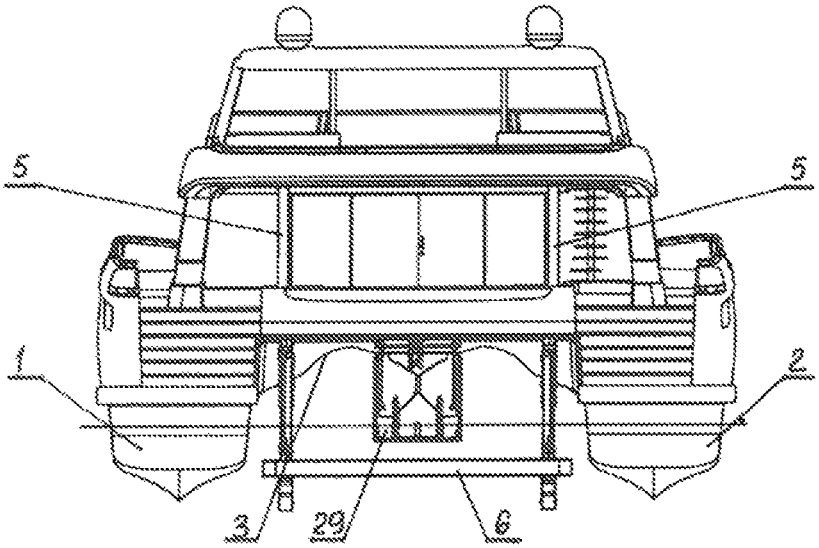
FIG. 10—a view of the vessel according to FIG. 9 in the direction corresponding to the axis of longitudinal symmetry.

FIG. 10 shows the subject of the invention in the second embodiment in a view from the stern side. The aft part of the vessel in this embodiment is also shown in a perspective view in FIG. 9. The platform 6 in the lower position is shown here, as can be seen in FIG. 10, below the waterline level. Adjacent to the platform 6, on the bow side of the vessel, a support flap 29 is visible in the open position, the lower edge of which is below the waterline marked in FIG. 10 by the symbol of a triangle. The support flap 29, when lowered, i.e. when opened, can be filled with a load in the form of multi-purpose equipment useful during the voyage.

Figure 11:
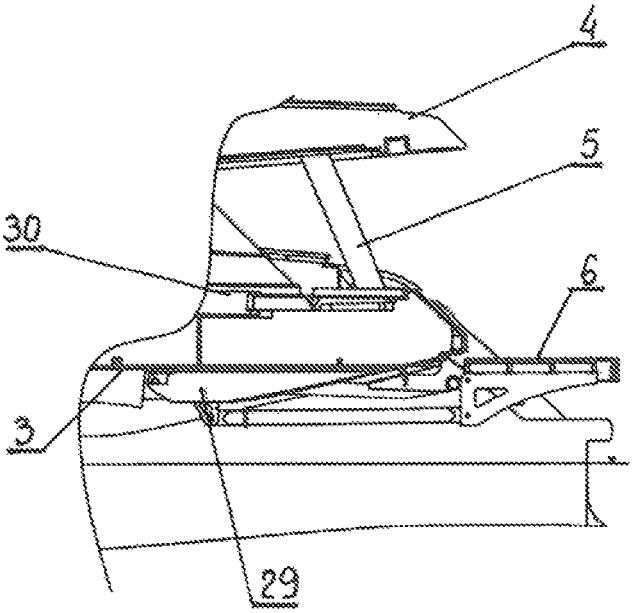
FIG. 11—a sectional view of the aft part of the vessel according to FIG. 9 with the support flap closed.
Figure 12:
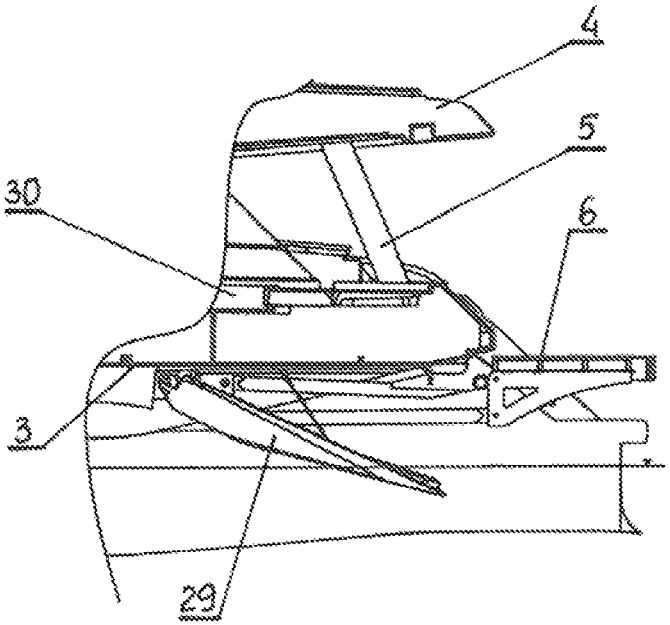
FIG. 12—a sectional view of the aft part of the vessel according to FIG. 9 with the support flap open.

FIG. 11 and FIG. 12 show the same portion of the aft part of the vessel in a cross-section with the platform 6 in the raised position. The position of the platform 6 shown in FIG. 11 is the resting position, during the voyage, when the platform 6 is not used. Usually a known pontoon motorboat, not shown in the drawings, is mounted on it.

Figure 13:
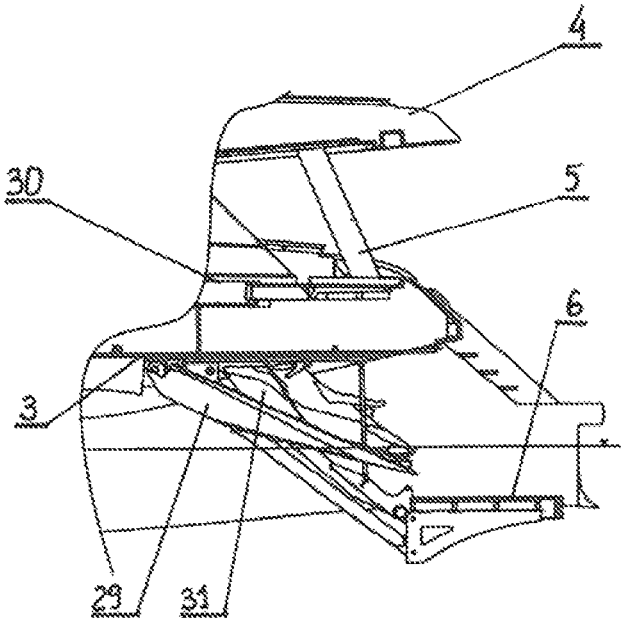
FIG. 13—a sectional view according to FIG. 12 with a personal watercraft visible.

In FIG. 11, the support flap 29 is in the closed position in which it usually is during the voyage. Under these conditions, the load stored on the support flap 29 from the inside of the vessel is protected against seawater during sailing and is accessible from the deck side through known tilting flaps on the deck 30. However, FIG. 12 shows the same support flap 29 in the open position. As can be seen, the free edge of the support flap 29 is below the water level. FIG. 13 shows that a personal watercraft 31 raised from the water is on the open support flap 29 as a load. The support flap 29 is dedicated in this embodiment for parking and taking the personal watercraft 31 out of the water. FIGS. 9 to 13 show that the support flap 29 can be lowered and lifted between the right and left pantographs of the platform 6 described above. In other embodiments, the support flap 29 can be used to store on board surfboards, diving equipment or other loads needed during the voyage.

Figure 14:
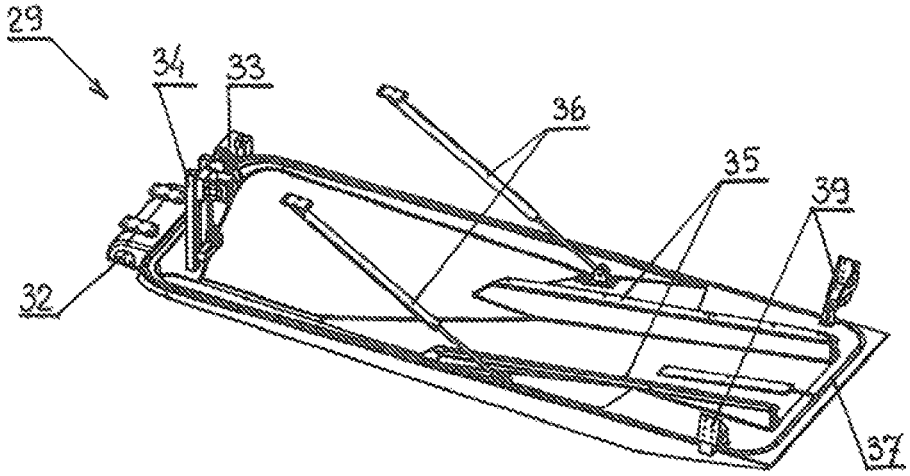
FIG. 14—the support flap.

The garage flap is shown in detail in an embodiment in FIG. 14. In this embodiment, the support flap 29 is rectangular and has an axis of rotation 32 assembly mounted on the shorter edge. The axis of rotation 32 assembly of the support flap 29 is attached from the other side to the connector 3 wall. Near the axis of rotation 32 a winch 33 is mounted on a frame 34. The winch 33 is used to pull the personal watercraft 31 out of the water to the surface of said support flap 29. In this embodiment, the support flap 29 is provided with guides 35 for this purpose. In this embodiment, the guides 35 are covered with a sliding Teflon coating.

After placing the personal watercraft 31 on the guides 35, the support flap 29 is lifted by cylinders 36 to the edge of the seat, not shown in the drawings, formed in the connector 3 wall. The seat of the support flap 29 is an opening in the hull 1,2 connector 3 wall with a known peripheral flange, where said seat is adapted to the shape of the support flap 29, and after raising the support flap 29 to the closed position, the flap 29 forms a sealed connection with the seat. A circumferential seal 37 of the contact of the edge of the support flap 29 and the edge of the seat of the connector 3 wall is shown in FIG. 14. The same figure also shows locks 39 of the closed position of the support flap 29. A change in the position of the bolts of the locks 39 of the support flap 29 is made by means of known cylinders supplied by a hydraulic working medium from a known hydraulic working medium supply system.

LIST OF DESIGNATIONS IN THE DRAWINGS

1. Side hull.
2. Side hull.
3. Connector.
4. Sun deck.
5. Pillar.
6. Platform.
7. Frame.
8. Usable overlay.
9. Edge of the platform.
10. Edge of the aft part of the connector.
11. Support.
12. Support.
13. Vertical edge of the support.
14. Axis of rotation.
15. Guide arm.
16. Fixing arm.
17. Axis of rotation.
18. Axis of rotation.
19. Cylinder piston rod.
20. Cylinder barrel.
21. End section of the guide arm.
22. Initial section of the guide arm.
23. Gusset plate.
24. Axis of the piston rod eye.
25. Initial part of the fixing arm.
26. End part of the fixing arm.
27. Flange.
28. Fastening clamps.
29. Support flap.
30. Deck.
31. Personal watercraft.
32. Axis of rotation of the support flap.
33. Winch.
34. Winch frame.
35. Guide.
36. Cylinder.
37. Seal.
38. Roller.
39. Lock.

The invention claimed is:

1. A catamaran type vessel comprising two rigid side hulls connected by a connector, where the hulls together with the connector constitute a rigid form containing the usable space of the vessel, which is provided with propulsion and control devices, wherein the vessel contains a lowered and lifted platform together with the platform drive unit, where the platform is a separate portion of the aft part of the deck and has the form of a flat frame with a usable overlay fixed on the surface of the frame, and at least one edge of the platform in the upper position cooperates with at least one edge of the aft part of the deck, with the platform frame being attached to the horizontal edges of at least two supports, where the rear vertical edge of each support is connected by axes of rotation with a pair of rigid arms in the pantograph system, and the rigid arms are hollow sections containing vertical axes of rotation attached on the other side of said rigid arms to the vessel hull connector wall, wherein in each pair of the rigid arms in the pantograph system, one arm is a guide arm and the other arm is a fixing arm, in each pair of the arms is connected by means of the axis of rotation with a cylinder piston rod for lowering and lifting the platform, wherein a barrel of said cylinder is tiltingly attached to the fixed part of the vessel structure, in the connector zone between the side hulls, wherein the fixed part of the vessel structure, to which the cylinder barrel for lifting and lowering the platform is tiltingly fixed, is the internal surface of the hollow section, which is the support pillar of the aft part of the next level of the vessel.

2. The vessel according to claim 1, wherein in the platform drive unit, the end section of the guide arm adjacent to the platform support is bent with respect to the other section of the guide arm so that the two sections of the guide arm form an obtuse angle and within this connection of said two sections, gusset plates are attached to the guide arm.

3. The vessel according to claim 2, wherein the axis of rotation at the end of the cylinder piston rod for lowering and lifting the platform is fixed between the gusset plates of each guide arm, between the arms of the obtuse angle and beyond the axes of longitudinal symmetry of both sections of the guide arm.

4. The vessel according to claim 2, wherein the gusset plates of each guide arm have a shape similar to the letter L, the shorter element of which is directed upwards and cooperating with the vessel side hull connector wall, constitutes a lock of the upper position of the platform.

5. The vessel according to claim 1, wherein the fixing arm in each pair of the arms in the pantograph system is a hollow section, which contains a transverse cut along its length dividing this arm into an initial part and an end part, wherein the parts of the fixing arm thus cut are provided with cooperating flanges connecting said parts of the fixing arm together.

6. The vessel according to claim 5, wherein between the flanges connecting the parts of the fixing arm there is at least one distance washer for adjusting the horizontal position of the platform.

7. The vessel according to claim 1, wherein at the bottom of the connector between the vessel hulls, adjacent to the platform, on the bow side of the vessel, a seat assembly with a tilting support flap is formed, wherein the tilting support flap is connected with the edge of the seat in the connector wall by means of the axis of rotation, wherein the support flap is provided with devices for pulling onto its surface and lowering a load, and a load securing assembly on the surface of said tilting support flap, wherein the support flap contains at least two locks fixing its position in the closed position.

8. The vessel according to claim 7, wherein a device for pulling and lowering a load is a winch mounted on the support flap near the edge of connection of said tilting support flap with the edge of the seat in the vessel hull connector bottom, wherein the tilting flap is provided on both sides with mounting eyes of the cylinder piston rods for closing and opening the flap.

9. The vessel according to claim 7, wherein a load on the upper surface of the tilting support flap is a personal watercraft.

10. The vessel according to claim 9, wherein a personal watercraft fixing assembly comprises guides attached to the upper surface of the carrier flap.

* * * * *